US009261057B2

(12) United States Patent
Kragh et al.

(10) Patent No.: US 9,261,057 B2
(45) Date of Patent: Feb. 16, 2016

(54) EVAPORATIVE EMISSION CONTROL

(71) Applicant: Ford Global Technologies, LLC, Dearborn, MI (US)

(72) Inventors: Niels Christopher Kragh, Commerce Township, MI (US); Michael G. Heim, Brownstown, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 571 days.

(21) Appl. No.: 13/670,675

(22) Filed: Nov. 7, 2012

(65) Prior Publication Data

US 2014/0123961 A1 May 8, 2014

(51) Int. Cl.

| | |
|---|---|
| ***F02M 25/08*** | (2006.01) |
| ***F02M 33/04*** | (2006.01) |
| ***F02D 29/02*** | (2006.01) |
| ***F02D 41/00*** | (2006.01) |

(52) U.S. Cl.

CPC ..... *F02M 33/04* (2013.01); *F02D 29/02* (2013.01); *F02D 41/004* (2013.01); *F02M 25/0809* (2013.01); *F02M 25/089* (2013.01); *F02M 25/0836* (2013.01); *F02M 25/0854* (2013.01)

(58) Field of Classification Search

CPC ..... B60K 6/46; B60L 11/123; B60L 11/1861; B60L 15/20; B60L 2240/441; F02M 25/0809; F02M 25/089; F02D 41/0032

USPC ..... 123/516–520, 336–337, 472

See application file for complete search history.

(56) References Cited

U.S. PATENT DOCUMENTS

| | | | | |
|---|---|---|---|---|
| 5,460,136 | A | 10/1995 | Yamazaki et al. | |
| 5,632,808 | A | 5/1997 | Hara et al. | |
| 5,743,943 | A | 4/1998 | Maeda et al. | |
| 5,878,729 | A | 3/1999 | Covert et al. | |
| 5,962,927 | A * | 10/1999 | Inada et al. | 290/40 R |
| 6,363,921 | B1 | 4/2002 | Cook et al. | |
| 6,695,896 | B2 | 2/2004 | Hara et al. | |
| 7,146,970 | B2 | 12/2006 | Everingham et al. | |
| 7,311,089 | B2 | 12/2007 | Balsdon | |
| 7,341,048 | B2 | 3/2008 | Koyama et al. | |
| 7,373,930 | B1 | 5/2008 | Hadre | |
| 7,438,059 | B2 | 10/2008 | Mills et al. | |
| 7,543,574 | B2 | 6/2009 | Yamazaki et al. | |
| 7,615,108 | B2 | 11/2009 | Yoshida et al. | |
| 2002/0162457 | A1 * | 11/2002 | Hyodo et al. | 96/109 |
| 2004/0094132 | A1 | 5/2004 | Fujimoto et al. | |
| 2007/0227515 | A1 * | 10/2007 | Uchida | 123/520 |
| 2009/0139495 | A1 | 6/2009 | Crawford | |
| 2013/0298879 | A1 * | 11/2013 | Pearce et al. | 123/520 |
| 2014/0224225 | A1 * | 8/2014 | Kragh | 123/520 |

OTHER PUBLICATIONS

Kragh, Niels Christopher, "System and Method for Gas Purge Control," U.S. Appl. No. 13/852,785, filed Mar. 28, 2013, 31 pages.

Kragh, Niels Christopher, "Purge Valve and Fuel Vapor Management System," U.S. Appl. No. 13/764,624, filed Feb. 11, 2013, 28 pages.

Pearce, Russell Randall et al., "Evaporative Emission Control," U.S. Appl. No. 13/466,528, filed May 8, 2012, 25 pages.

Toyota Motor Sales, U.S.A., "Emission Sub Systems—Evaporative Emission Control System," 11 pages.

* cited by examiner

*Primary Examiner* — Hai Huynh
*Assistant Examiner* — Gonzalo Laguarda
(74) *Attorney, Agent, or Firm* — James Dottavio; Alleman Hall McCoy Russell & Tuttle LLP

(57) ABSTRACT

Methods and systems are provided for purging a multi-port canister into an engine intake. Air is circulated through the canister and a resulting purge air is directed to an intake passage upstream of a throttle in engine configured with a throttle body. An amount of fresh intake air received at the intake passage is corresponding decreased.

19 Claims, 8 Drawing Sheets

EVAPORATIVE EMISSION CONTROL

FIELD

The present invention relates to purging of a canister coupled to a fuel system in hybrid vehicles and other vehicles with limited engine operation times.

BACKGROUND AND SUMMARY

Vehicles may be fitted with evaporative emission control systems to reduce the release of fuel vapors to the atmosphere. For example, vaporized hydrocarbons (HCs) from a fuel tank may be stored in a fuel vapor canister packed with an adsorbent which adsorbs and stores the fuel vapors. At a later time, when the engine is in operation, the evaporative emission control system allows the fuel vapors to be purged into the engine intake manifold from the fuel vapor canister. The fuel vapors are then consumed during combustion.

In one example described by Covert et al. in U.S. Pat. No. 5,878,729, a fuel vapor canister includes a plurality of inlet ports and purge ports regulated by respective valves. During operation of the engine, the purge valves and the air inlet valves are opened to supply a negative pressure from an engine air induction passage to within the canister. As a result of the supply of the vacuum, fuel vapor is purged to the intake manifold of the engine from the fuel vapor canister.

However, the inventors herein have recognized issues with the above approach. For example, in engine applications that operate with low vacuum air induction, or near atmospheric pressure (as measured post throttle body in the engine's intake manifold), the small amount of vacuum may not be enough to sufficiently purge the fuel vapor canister. More particularly, in hybrid electric vehicle (HEV) applications, the engine run time may be shorter than the amount of time it takes to purge the fuel vapor canister with low vacuum. As such, if the canister is not completely purged, exhaust hydrocarbons may slip into the atmosphere, degrading exhaust emissions and making the vehicle emissions non-compliant. In addition, the low vacuum may increase the engine operation time required to purge the fuel vapor canister. The unintended increase in engine run time for the hybrid vehicle can degrade vehicle fuel economy.

Thus, in one example, some of the above issues may be at least partly addressed by a method for operating an engine comprising displacing an amount of unthrottled intake air with air received from a fuel system canister. In this way, a fuel system canister can be purged even when there is low vacuum induction in an engine.

For example, a fuel system canister may be purged using intake air that is substantially at atmospheric conditions. The canister may be a multi-port canister having a plurality of intake ports or vents, as well as a plurality of purge ports. When purging conditions are met, a vent control valve may be opened to enable atmospheric air to enter the canister through the multiple vents and desorb stored fuel vapors from the canister. The fuel vapors may then be purged to an engine intake upon passage through the multiple purge ports by opening a purge valve. A diverter valve coupled between the purge line and an intake passage may be opened so that the fuel vapors can be received upstream of an intake throttle. In particular, the opening of the diverter valve may be adjusted so that an amount of intake air received in the engine intake is displaced by the ingested fuel vapors. For example, as the amount of fuel vapors ingested increases, an amount of intake air may be correspondingly decreased.

In this way, a purge flow is created by redirecting an amount of incoming engine air mass from an engine's air cleaner to enter from a fuel vapor canister. By using air that is substantially at atmospheric pressure to purge a canister, a vacuum requirement for purging is reduced. By purging multiple regions of the canister simultaneously, a time required to completely purge the canister is lowered. By better enabling canister purging to be completed, the likelihood of attaining zero bleed emissions from the canister is increased. By displacing an amount of intake air directed to an engine with fuel vapors received from a canister, and by mixing intake air with the fuel vapors upstream of an intake throttle before delivering the mixture to an intake manifold, a combustion air-to-fuel ratio can be maintained. Overall, exhaust emissions and emissions compliance may be improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
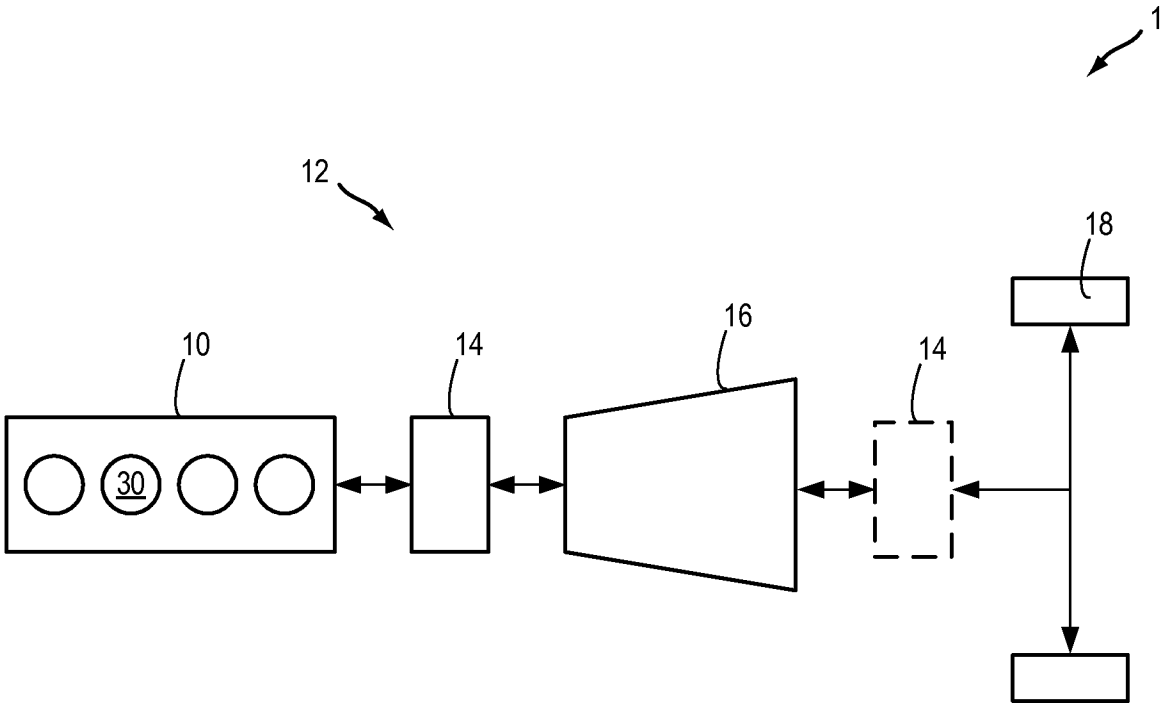
FIG. 1 schematically shows an example of a hybrid propulsion system according to an embodiment of the present disclosure.
Figure 6:
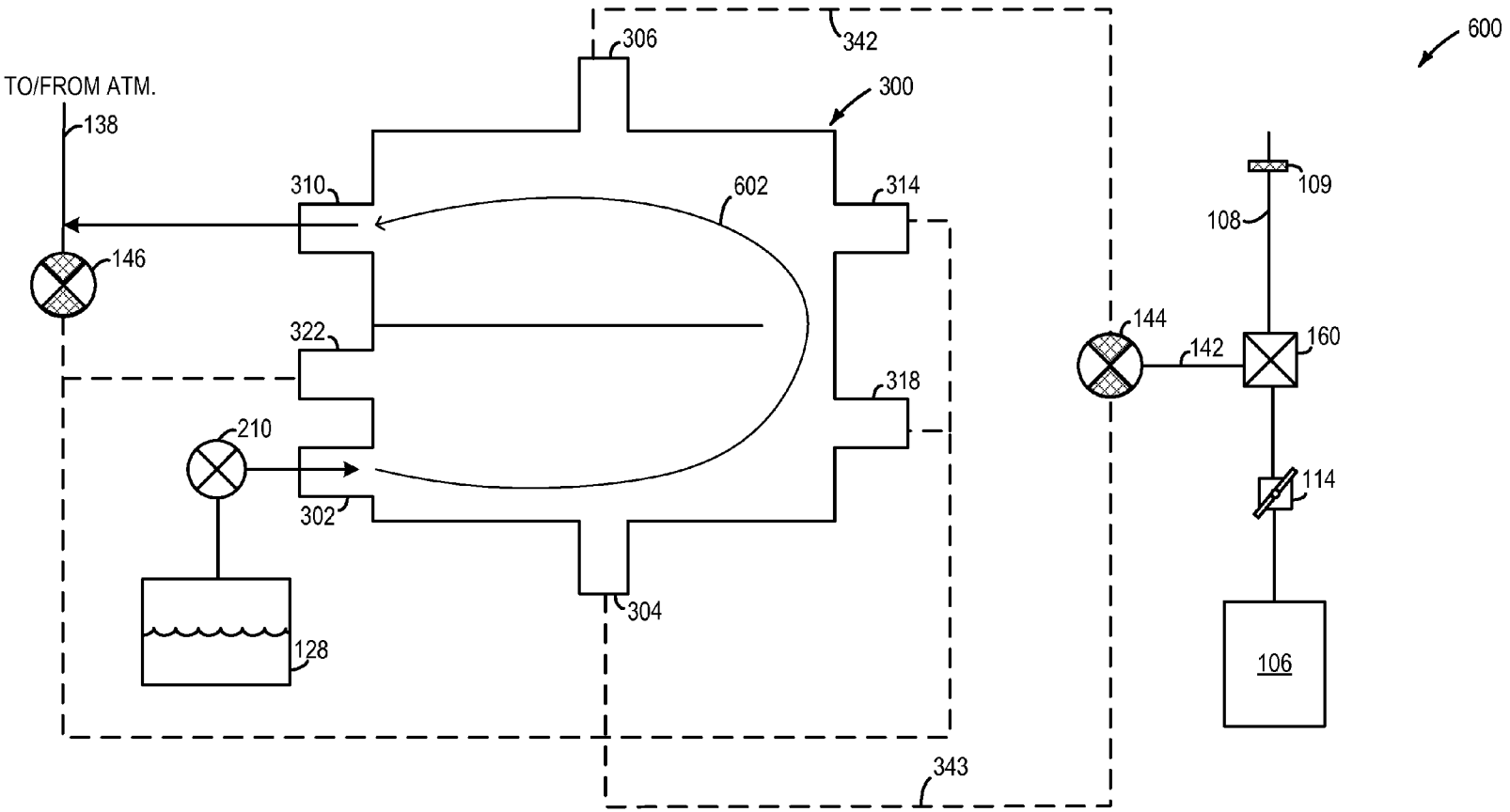
FIG. 6 shows fuel tank vapors being stored in the fuel vapor canister during refueling conditions.
Figure 7:
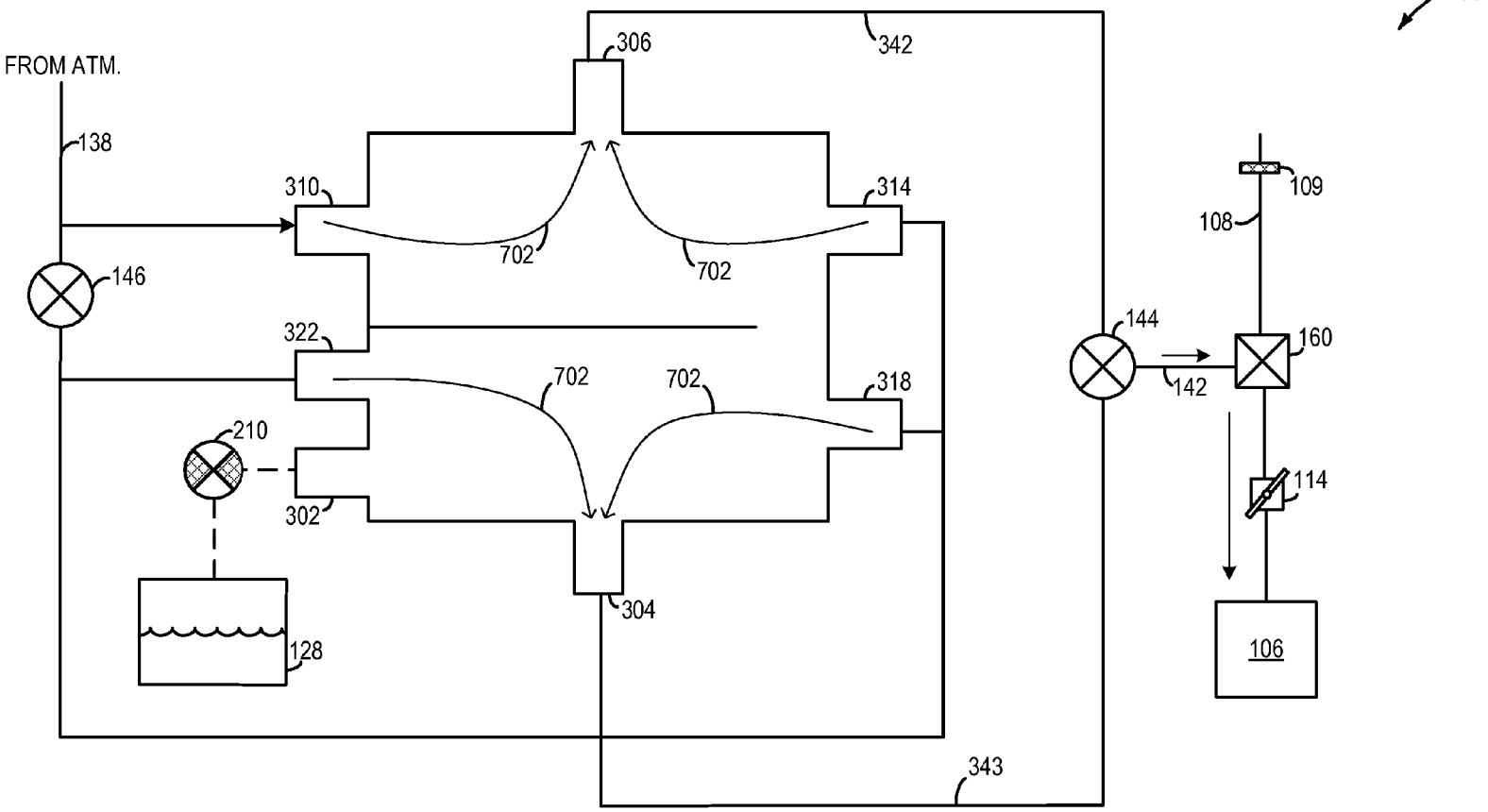
FIG. 7 shows fuel tank vapors being purged from the fuel vapor canister during purging conditions.

The present description relates to controlling evaporative emissions in a vehicle, such as the hybrid vehicle of FIG. 1. More particularly, the present disclosure relates to purging fuel vapors from a multi-port canister of a vehicle fuel system, such as the canister of FIGS. 2-5. During refueling conditions, each of a vent valve and a purge valve of the canister may be closed to allow the canister to be loaded with fuel vapors from the fuel tank (FIG. 6). Then, during purging conditions, each of the vent valve and the purge valve of the canister may be opened to allow fresh air to enter the canister and purge the fuel vapors to an engine intake air passage, upstream of an intake throttle (FIG. 7). A controller may be configured to perform a control routine, such as the example routine of FIG. 8, to adjust the position of a diverter valve at a junction of the purge line and the air intake passage so as to displace an amount of intake air with fuel vapors received upstream of the throttle. Further, in engines configured without an intake throttle and that only operate by controlled intake valve timing (such as in TiVCT engines), purge air may be received between the diverter valve (BPV) and the engine intake valves. Such an approach may enable canister purging to be completed in low vacuum air induction engine applications. Furthermore, such an approach may be applicable to hybrid electric vehicle (HEV) applications and other applications with limited engine run time.

FIG. 1 schematically shows an example of a vehicle system 1 according to an embodiment of the present disclosure. The vehicle 1 includes a hybrid propulsion system 12. The hybrid propulsion system 12 includes an internal combustion engine 10 having one or more cylinders 30, a transmission 16, drive wheels 18 or other suitable device for delivering propulsive force to the ground surface, and one or more motors 14. In this way, the vehicle may be propelled by at least one of the engine or the motor. The engine may include a turbocharger boosting intake air, the turbocharger including a compressor and a turbine, the turbine driven by exhaust flow.

In the illustrated example, one or more of the motors 14 may be operated to supply or absorb torque from the driveline with or without torque being provided by the engine. Accordingly, the engine 10 may operate on a limited basis. Correspondingly, there may be limited opportunity for fuel vapor purging to control evaporative emissions. It will be appreciated that the vehicle is merely one example, and still other configurations are possible. Therefore, it should be appreciated that other suitable hybrid configurations or variations thereof may be used with regards to the approaches and methods described herein. Moreover, the systems and methods described herein may be applicable to non-HEVs, such as vehicles that do not include a motor and are merely powered by an internal combustion.

Figure 2:
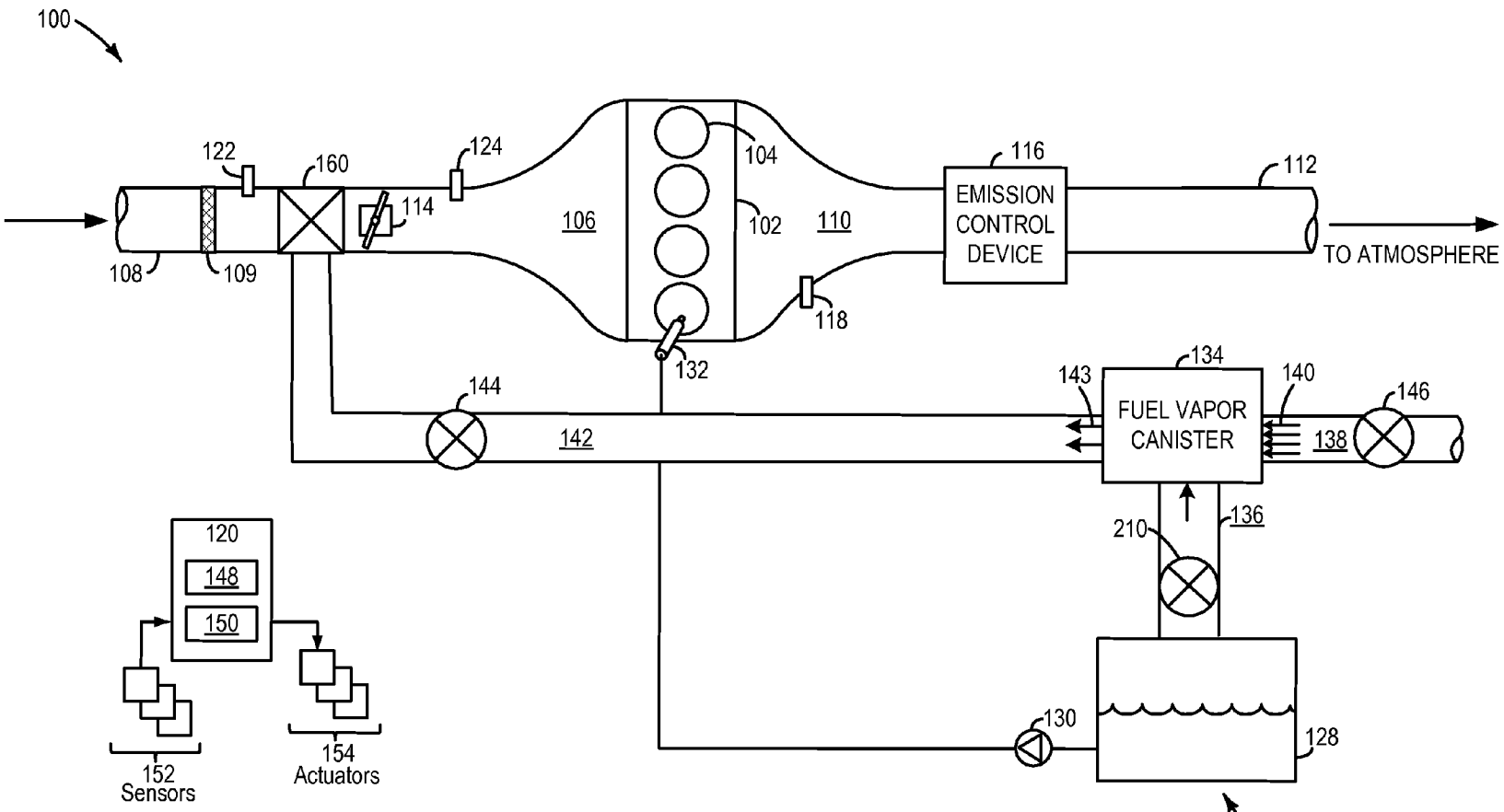
FIG. 2 schematically shows an example of an engine and an associated fuel system according to an embodiment of the present disclosure.

FIG. 2 schematically shows an example of an engine system 100 according to an embodiment of the present disclosure. For example, the engine system 100 may be implemented in the vehicle system 1 shown in FIG. 1. The engine system 100 includes an engine block 102 having a plurality of cylinders 104. The cylinders 104 may receive intake air from an intake manifold 106 via an intake passage 108 and may exhaust combustion gases to an exhaust manifold 110 and further to the atmosphere via exhaust passage 112. The intake air received in the intake passage 108 may be cleaned upon passage through an intake air cleaner 109.

The intake passage 108 may include a throttle 114. In this particular example, the position of the throttle 114 may be varied by a controller 120 via a signal provided to an electric motor or actuator included with the throttle 114, a configuration that is commonly referred to as electronic throttle control (ETC). In this manner, the throttle 114 may be operated to vary the intake air provided to the plurality of cylinders 104. The intake passage 108 may include a mass air flow sensor 122 and a manifold air pressure sensor 124 for providing respective signals MAF and MAP to the controller 120. As further elaborated below, the intake passage may also include a diverter valve 160 (herein also known as a balance purge valve) positioned upstream of throttle 114. By adjusting a position of diverter valve 160, the controller may adjust an amount of fresh intake air that is mixed with fuel vapors from a fuel system canister upstream of the throttle. The air mixture may then be delivered to the intake manifold.

Further, for engine technologies that do not use a throttle body, the diverter valve may be included in the air induction system (AIS) between the air cleaner and engine intake manifold. For example, in engines configured without an intake throttle and that only operate by controlled intake valve timing (such as in TiVCT engines), purge air may be received between the diverter valve (BPV) and the engine intake valves. Further still, in engines that are configured with a boosting device (such as a turbocharger or supercharger), the diverter valve may be installed between the air cleaner and boosting device.

In this way, diverter valve 160 allows a mixture of atmospheric air to enter the engine's Air Induction System (AIS) in varying amounts from either the air cleaner and or canister system during engine operation. The diverter valve may be controlled by a controller 120 (e.g., such as an Engine's Control Modal (ECM)) during purge operations. The controller may adjust the diverter valve to allow all or varying ratios of engine air mass to enter the AIS from either air cleaner and or canister system. All engine air mass may be introduced to the engine from the canister system if engine operation air mass requirements are satisfied, such as at idle. Also, controlled diverted engine air mass amounts may depend on hydrocarbon concentration at any given time during canister purge operation. For example, if it is determined by the controller that the purge air mixture coming from the canister has a high concentration of hydrocarbon the controller may reduce the diverter valve's opening to the canister and allow more (fresh) air to enter the engine from the air cleaner. Controller 120 may also adjust the diverter to allow more engine air mass from the canister system with a reduction of hydrocarbon concentration from purge air and canister.

An emission control device 116 is shown arranged along the exhaust passage 112. The emission control device 116 may be a three way catalyst (TWC), NOx trap, various other emission control devices, or combinations thereof. In some embodiments, during operation of the engine 100, the emission control device 116 may be periodically reset by operating at least one cylinder of the engine within a particular air/fuel ratio. An exhaust gas sensor 118 is shown coupled to the exhaust passage 112 upstream of the emission control device 116. The sensor 118 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. It will be appreciated that the engine system 100 is shown in simplified form and may include other components.

A fuel injector 132 is shown coupled directly to the cylinder 104 for injecting fuel directly therein in proportion to a pulse width of a signal received from the controller 120. In this manner, the fuel injector 132 provides what is known as direct injection of fuel into the cylinder 104. The fuel injector may be mounted in the side of the combustion chamber or in the top of the combustion chamber, for example. Fuel may be delivered to the fuel injector 132 by a fuel system 126. In some embodiments, cylinder 104 may alternatively or additionally include a fuel injector arranged in intake manifold 106 in a configuration that provides what is known as port injection of fuel into the intake port upstream of the cylinder 104.

The fuel system 126 includes a fuel tank 128 coupled to a fuel pump system 130. The fuel pump system 130 may include one or more pumps for pressurizing fuel delivered to the injectors 132 of the engine 100, such as the fuel injector 132. While only a single injector 132 is shown, additional injectors are provided for each cylinder. It will be appreciated that fuel system 126 may be a return-less fuel system, a return fuel system, or various other types of fuel system.

Vapors generated in the fuel system 126 may be directed to an inlet of a fuel vapor canister 134 via a vapor recovery line 136. The fuel vapor canister may be filled with an appropriate adsorbent to temporarily trap fuel vapors (including vaporized hydrocarbons) during fuel tank refilling operations and "running loss" (that is, fuel vaporized during vehicle operation). In one example, the adsorbent used is activated charcoal.

In embodiments where engine system 100 is coupled in a hybrid vehicle system, the engine may have reduced operation times due to the vehicle being powered by engine system 100 during some conditions, and by a system energy storage device or motor under other conditions. While the reduced engine operation time reduces overall carbon emissions from the vehicle, it may also lead to insufficient purging of fuel vapors from the vehicle's emission control system. To address this, a fuel tank isolation valve 210 may be optionally included in vapor recovery line 136 such that fuel tank 128 is coupled to canister 134 via the isolation valve 210. During regular engine operation, isolation valve 210 may be kept closed to limit the amount of diurnal or "running loss" vapors directed to canister 134 from fuel tank 128. During refueling operations, and selected purging conditions, isolation valve 210 may be temporarily opened, e.g., for a duration, to direct fuel vapors from the fuel tank 128 to canister 134. By opening the valve during conditions when the fuel tank pressure is higher than a threshold (e.g., above a mechanical pressure limit of the fuel tank above which the fuel tank and other fuel system components may incur mechanical damage), the refueling vapors may be released into the canister and the fuel tank pressure may be maintained below pressure limits. While the depicted example shows isolation valve 210 positioned along vapor recovery line 136, in alternate embodiments, the isolation valve may be mounted on fuel tank 128.

The fuel vapor canister 134 may be fluidly coupled to a vent line 138 via a plurality of air inlets 140. In one embodiment, one or more of the plurality of air inlets 140 may be concomitantly opened by actuating a common vent control valve 146 to fluidly couple different regions of the fuel vapor canister 134 with the vent line 138. For example, as elaborated at FIG. 3, the canister may include four air vents wherein three of the four vents are fluidly coupled to the vent line by actuating a common vent control valve 146 while the fourth vent is coupled to the vent line uncontrolled. In other embodiments, each of the vents may have respective vent valves that are independently controlled. Under some conditions, the vent line 138 may route gases out of the fuel vapor canister 134 to the atmosphere, such as when storing, or trapping, fuel vapors of the fuel system 126. In particular, as elaborated herein, gases may be routed out of the canister via at least one of the plurality of air inlets 140 and then through vent line 138.

The fuel vapor canister 134 may be fluidly coupled to a purge line 142 via a plurality of purge ports 143. In one embodiment, one or more of the plurality of purge ports 143 may be concomitantly opened by actuating a common purge control valve 144 to fluidly couple different regions of the fuel vapor canister 134 with the purge line 142. For example, as elaborated at FIG. 3, the canister may include two purge ports which may be fluidly coupled to the purge line by actuating a common purge control valve 144. In other embodiments, each of the purge ports may have respective valves that are independently controlled.

Vent line 138 may allow fresh air to be drawn into the fuel vapor canister 134 when purging stored fuel vapors through one or more purge ports 143 of the fuel vapor canister to the intake manifold 106 via purge line 142. In particular, fresh air may be drawn into the canister via one or more of the plurality of air inlets 140 and purged to the intake manifold via the plurality of purge ports 143. Purge control valve 144 may be positioned in the purge line and may be controlled by the controller 120 to regulate flow from the fuel vapor canister to the intake manifold 106 while vent control valve 146 positioned in the vent line may be controlled by the controller 120 to regulate the flow of air and vapors between the fuel vapor canister 134 and the atmosphere.

During purging, a purge air mass may be measured by the engine MAF sensor 122 or referenced from calibrated inferred purge air mass table values. Atmospheric air may enter the fuel vapor canister, during purge, through the engine air cleaner and MAF sensor to measure purge air mass. If not measured by the MAF sensor, purge air mass from the atmosphere entering the canister may be inferred from bench flow data populated in PCM strategy purge air mass tables. Hydrocarbon or oxygen sensor outputs may be used to determine a purge air hydrocarbon concentration which is then controlled using engine air-to-fuel ratio feedback PCM algorithms. In alternate embodiments, an inline sensor and a feed-forward strategy may be used to measure the hydrocarbon concentration of the purge air. The in-line sensor may be located in intake manifold 106, or between the diverter valve 160 and intake manifold 106. Alternatively, the in-line sensor may be configured to sense the hydrocarbon concentration in the incoming purge air received within the purge line 142 or within diverter valve 160.

The controller 120 is shown in FIG. 1 as a microcomputer, including microprocessor unit 148, input/output ports, a computer readable storage medium 150 for executable programs and calibration values (e.g., read only memory chip, random access memory, keep alive memory, etc.) and a data bus. Storage medium read-only memory 150 can be programmed with computer readable data representing instructions executable by the processor 148 for performing the methods described below as well as other variants that are anticipated but not specifically listed.

The controller 120 may receive information from a plurality of sensors 152 of the engine system 100 that correspond to measurements such as inducted mass air flow, engine coolant temperature, ambient temperature, engine speed, throttle position, manifold absolute pressure signal, air/fuel ratio, fuel fraction of intake air, fuel tank pressure, fuel canister pressure, etc. Note that various combinations of sensors may be used to produce these and other measurements. Furthermore, the controller 120 may control a plurality of actuators 154 of the engine 100 based on the signals from the plurality of sensors 152. Examples of actuators 154 may include vent control valve 146, purge control valve 144, diverter valve 160, throttle 114, fuel injector 132, etc.

In one example, the controller 120 includes computer readable medium 150 having instructions that when executed by the processor 148, displaces an amount of intake air received upstream of a throttle (in engine systems configured with a throttle), with air (including fuel vapors) received from a fuel system canister. By mixing the fresh intake air with the purge air upstream of the throttle, and then delivering the air mixture to the engine intake, the delivery of purge air can be coordinated with the delivery of fresh air. By purging the canister to an engine intake upstream of the throttle, the vacuum requirement for canister purging is reduced. By using air that is substantially at or around atmospheric pressure conditions to purge the canister, the canister can be quickly and thoroughly purged even in low vacuum air induction engine systems and engines having shortened run time, such as with HEVs.

Likewise, in engine systems configured without a throttle and controlled via TiVCT intake valves, an amount of intake received in the intake manifold is displaced. Therein, purge air may enter between the diverter valve and the engine intake valves.

In one example, the fuel vapor canister is purged until a fuel fraction of combustion gases exhausted from the cylinders is less than a set point. During the purging, the vent control valve is opened to receive atmospheric air in the canister and desorb the stored fuel vapors. The diverter valve is also adjusted to a position that allows fresh intake air received in the air intake passage to be displaced with the purged canister fuel vapors received along the purge line. Fresh air may be mixed with the fuel vapors at the diverter valve, upstream of the throttle, before the homogeneous air mixture is delivered to the engine intake manifold for combustion in the cylinders. Then, once the set point for the canister is achieved, the vent control valve may be closed and a position of the diverter valve is readjusted so that fresh air is not displaced by the fuel vapors and so that more fresh air rather than an air-fuel vapor mixture is directed to the engine. In alternate embodiments, different regions of the fuel vapor canister may be purged sequentially.

Figure 3:
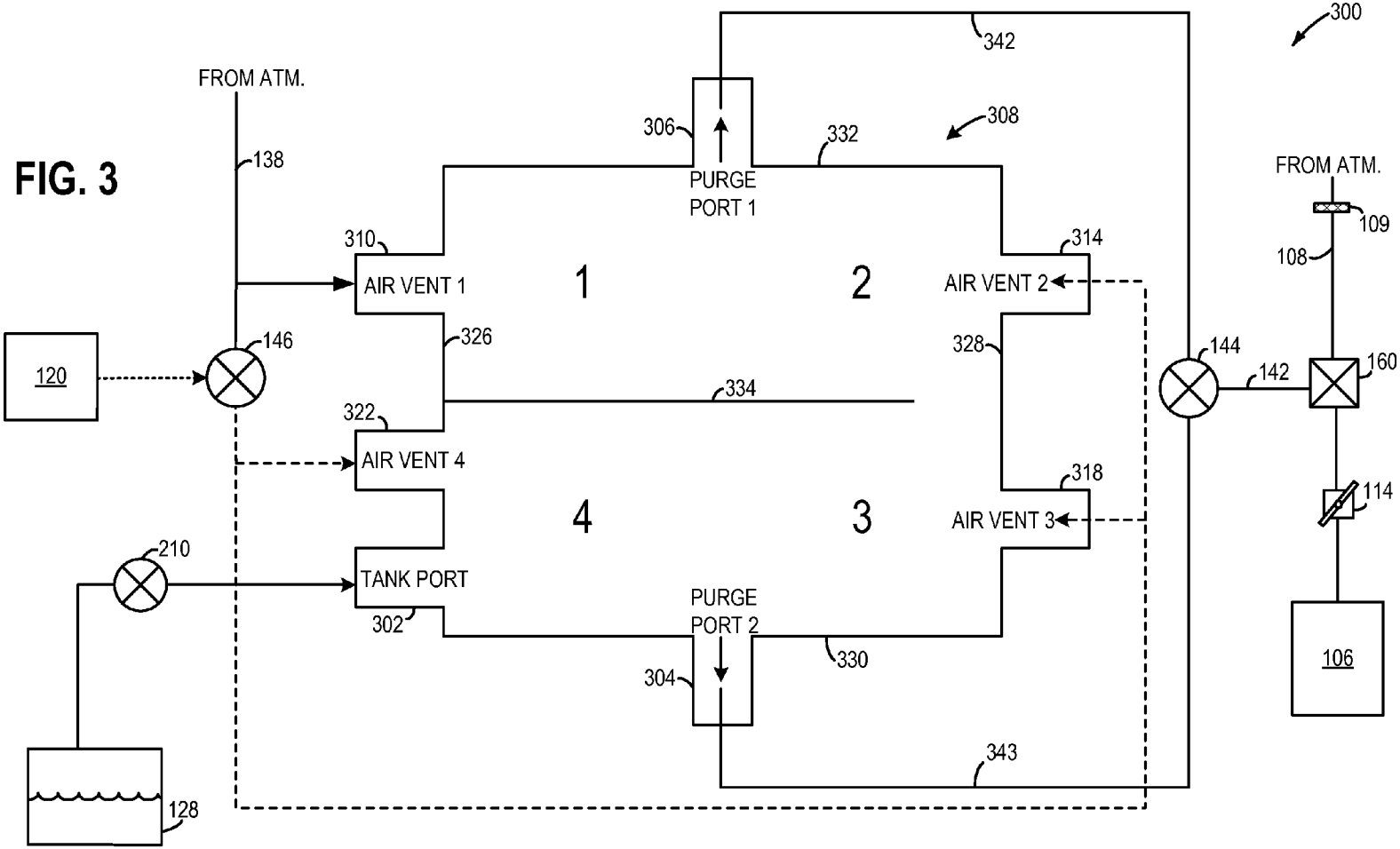
FIGS. 3-5 show example embodiments of a fuel vapor canister coupled in the fuel system of FIG. 2.

FIG. 3 schematically shows a first example embodiment of a fuel vapor canister 300 according to an embodiment of the present disclosure. In one example, the canister 300 may be implemented in the engine system 100 shown in FIG. 2. It will be appreciated that engine system components introduced in FIGS. 1-2 are numbered similarly and not reintroduced. Likewise, canister components introduced in FIG. 3 are numbered similarly in FIGS. 4-5 and not reintroduced.

The canister 300 includes a tank port 302 fluidly coupled with fuel tank 128. The tank port 302 is a canister inlet that permits fuel vapors that escape from the fuel tank to enter the canister 300 for storage when fuel tank isolation valve 210 is opened. In one example, the canister 300 is filled with activated charcoal to store the received fuel vapors.

The canister 300 includes a plurality of regions 308 (e.g., 1, 2, 3, 4) that may store fuel vapors. In some embodiments, the canister 300 may include a dividing wall 334 that may partially divide the regions of the canister. In alternate embodiments, canister 300 may or may not have a dividing wall and or air gaps, example, for packaging reasons, between each region. In those cases, tunnels and/or flexible hose material may connect each section/region of the canister to one another, thereby preserving the technique of the canister's technology. In particular, the purge port and/or vent connection positions remain, with air being introduced to the ports via a hose or tunnel rather than the housing.

The plurality of regions 308 may be simultaneously purged according to a fuel purging method discussed in further detail below. The canister 300 further includes a plurality of air vents 310, 314, 318, 322, with each air vent associated with a distinct region of the canister and being dedicated to delivering fresh air from the atmosphere to the dedicated region. In the illustrated embodiment, the canister includes four regions and four air vents corresponding to the four regions. Thus, a first canister region (1) may receive fresh air along first air vent 310 (Air Vent 1), while a second canister region (2) receives fresh air along second air vent 314 (Air Vent 2), a third canister region (3) receives fresh air along third air vent 318 (Air Vent 3) and a fourth canister region (4) receives fresh air along fourth air vent 322 (Air Vent 4).

In the illustrated embodiment, two pairs of air vents are located on opposing sides of the canister. Specifically, the first air vent 310 is positioned across from the second air vent 314 while the third air vent 318 is positioned across from the fourth air vent 322. In addition, first air vent 310 and fourth air vent 322 are positioned on a common first side 326 of the canister while second air vent 314 and third air vent 318 are positioned on a second, different side 328 of the canister that opposes first side 326. As such, each air vent is positioned such that during purging of the corresponding region, air flows from that air vent through the region to the nearest purge outlet. By passing intake air through multiple vent ports located at each end of the canister, purge flow restriction reductions are achieved. In some embodiments, each chamber or region of carbon may be divided by an air gap positioned relevant to a closest purge port to further reduce purge flow restrictions. In one example, the restriction reductions achieved could be equal to engine induction system restrictions in order to not cause engine manifold fill miscalculations.

The canister 300 further includes a common vent control valve 146 associated with three of the four air vents. Specifically, vent control valve 146 controls an amount of fresh air received from the atmosphere along vent line 138 and delivered to the canister 300 through second air vent 314 to the second region; third air vent 318 to the third region; and fourth air vent 322 to the fourth region. Air flow into and out of first air vent 310 is not controlled by common vent control valve 146. As such, the uncontrolled air vent corresponds to the air vent that is located furthest away, in terms of fuel vapor flow, from tank port 302. During fuel tank refueling conditions, the vent control valve 146 may be actuated closed by controller 120 so that second, third, and fourth air vents 314, 318, and 322 are closed and only first air vent 310 is open. Consequently, fuel tank vapors entering tank port 302 can be vented to the atmosphere only after flowing through the greatest length of canister adsorbent (e.g., carbon) and exiting via first air vent (as shown by arrow). This increases the residence time of the fuel vapors in the canister and improves their adsorption efficiency. It will be appreciated that while the depicted embodiment of the canister shows three of the four air vents coupled to a common vent control valve, in alternate embodiments of the canister, each air vent may be coupled to a respective vent control valve wherein air flow through each air vent may be controlled by controlling the opening of the respective vent control valve.

Canister 300 further includes a plurality of purge ports including a first purge port 304 and a second purge port 306 fluidly coupled with an intake manifold (e.g., intake manifold 106 shown in FIG. 2). The first and second purge ports 304 and 306 permit fuel vapors desorbed from canister 300 to travel to the intake manifold via purge line 142 during purging, so that the fuel vapors can be consumed by combustion instead of being vented to the atmosphere. Fuel vapors desorbed from the canister may be directed from first purge port 306 into first purge branch 342 and from second purge port 304 into second purge branch 343. From the purge branches 342, 343, the fuel vapors may be directed to a common purge line 142. The first and second purge ports 304, 306 are positioned on diametrically opposite sides of the canister. Specifically, the first purge port 304 is located on a first side 330 and the second purge port is located on a second side 332 that opposes the first side 330. This allows fuel vapors to be simultaneously purged from the canister to the intake manifold from opposite ends of the canister. In particular, the purge ports being positioned on opposing sides facilitates the purging of fuel vapors from the different regions of the canister in substantially the same or similar manner. In other words, no region is positioned farther away from a purge port than any other region in the canister. Accordingly, the amount of time it takes to purge each region may be similar or substantially the same. The various canister purge ports and air vents may be encompassed within an outer shell or housing (as depicted) and/or passageway of the canister to reduce the number of connections. It will be appreciated that the canister may include any suitable number of purge ports that may be located in any suitable position on the canister without departing from the scope of the present disclosure.

Furthermore, the first and second purge ports 304 and 306 are located on different sides of the canister from the plurality of air vents. As depicted, the purge ports are positioned perpendicular to the air vents. In this way, air flowing through any air vent flows through a corresponding region of the canister to reach a purge outlet. For example, air received through air vents 310 and 314 may be purged through purge port 306 while air received through air vents 318 and 322 may be purged through purge port 304. The dividing wall 334 may help direct air flow through a particular region during purging by at least partially blocking access to other regions of the canister. It will be appreciated that the canister may include any suitable number of air vents that may be located in any suitable position on the canister without departing from the scope of the present disclosure.

The canister 300 further includes a purge control valve 146. Controller 120 may open purge control valve 146 during purging conditions to control an amount of fuel vapors received from purge branches 342, 343 into purge line 142, and from there to the intake manifold. As such, the fuel vapors may be directed along purge line 142 into engine air intake passage 108 upstream of intake throttle 114 (or in engines configured without a throttle and that only operate by controlled intake valve timing, TiVCT engines, the purge air enters between diverter valve and the engine intake valves). Thus, an amount of fresh air received in the intake passage may be displaced by the ingested fuel vapors. Purge line 142 may be coupled to the intake passage 108 at a junction including diverter valve 160. During purging conditions, controller 120 may control a position of diverter valve to adjust an amount of fresh air that is displaced by the fuel vapors. In particular, the diverter valve may divert an incoming amount of the engine's air flow to enter through the canister and may reduce an equal amount of air mass received from in the intake passage from air cleaner 109. Based on operating conditions, the diverter valve may be adjusted to a first, fully open position where only fresh air that has been cleaned through air cleaner 109 is received in the intake passage while no purge vapors are received, a second, fully closed position where only purge vapors are received in the intake passage while no fresh air is received, or any position in-between. In some embodiments, diverter valve 160 may also include a chamber wherein fuel vapors received from purge line 142 are mixed with the fresh air received from air cleaner 109 before the air mixture is delivered to the engine intake, upstream of the throttle. The homogenous air mixture is then introduced into the engine intake manifold 106 for combustion.

As elaborated below, FIG. 6 shows an example of the fuel vapor canister, including a position of all the coupled valves, during refueling or fuel vapor storing conditions. Further, FIG. 7 shows an example of the fuel vapor canister, including a position of all the coupled valves, during purging conditions.

Figure 4:
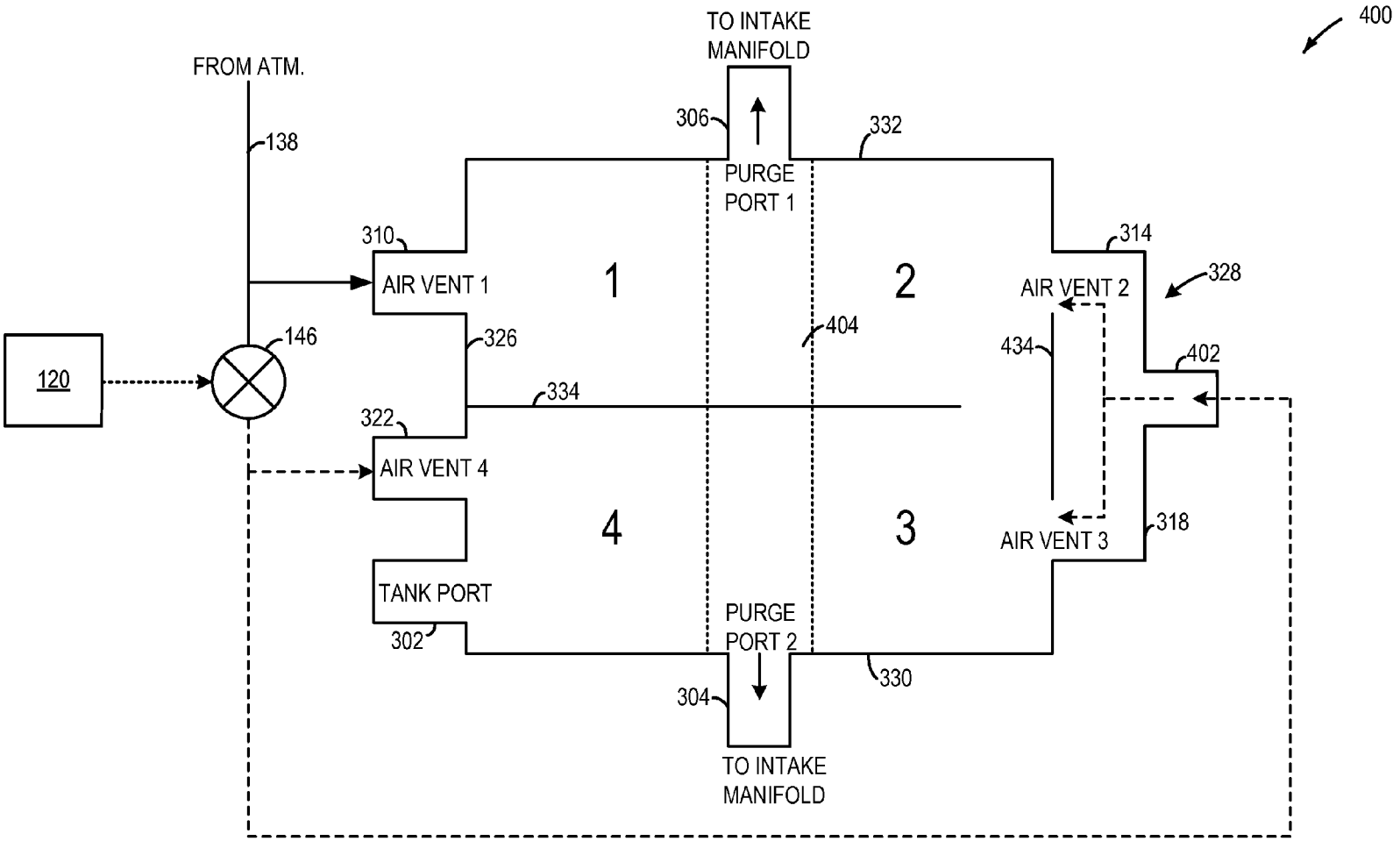

Now turning to FIG. 4, an alternate embodiment 400 is shown for a fuel vapor canister. In the depicted embodiment, the external housing of the canister on the second side 328 is modified to reduce the number of connections. In particular, each of second air vent 314 and third air vent 318 is configured to receive air via a common intake vent 402. Further, within the canister, second air vent 314 and third air vent 318 are separated from each other by vent dividing wall 434. In addition, the canister may include an air gap 404 for lowering restriction within the canister during purge. The substantially lower restriction allows engine air induction to be mimicked, improving canister purging efficiency during low vacuum availability. In some embodiments, the different chambers or regions of the canister may be divided with an air gap relevant to the purge port to further reduce purge flow restrictions.

Figure 5:
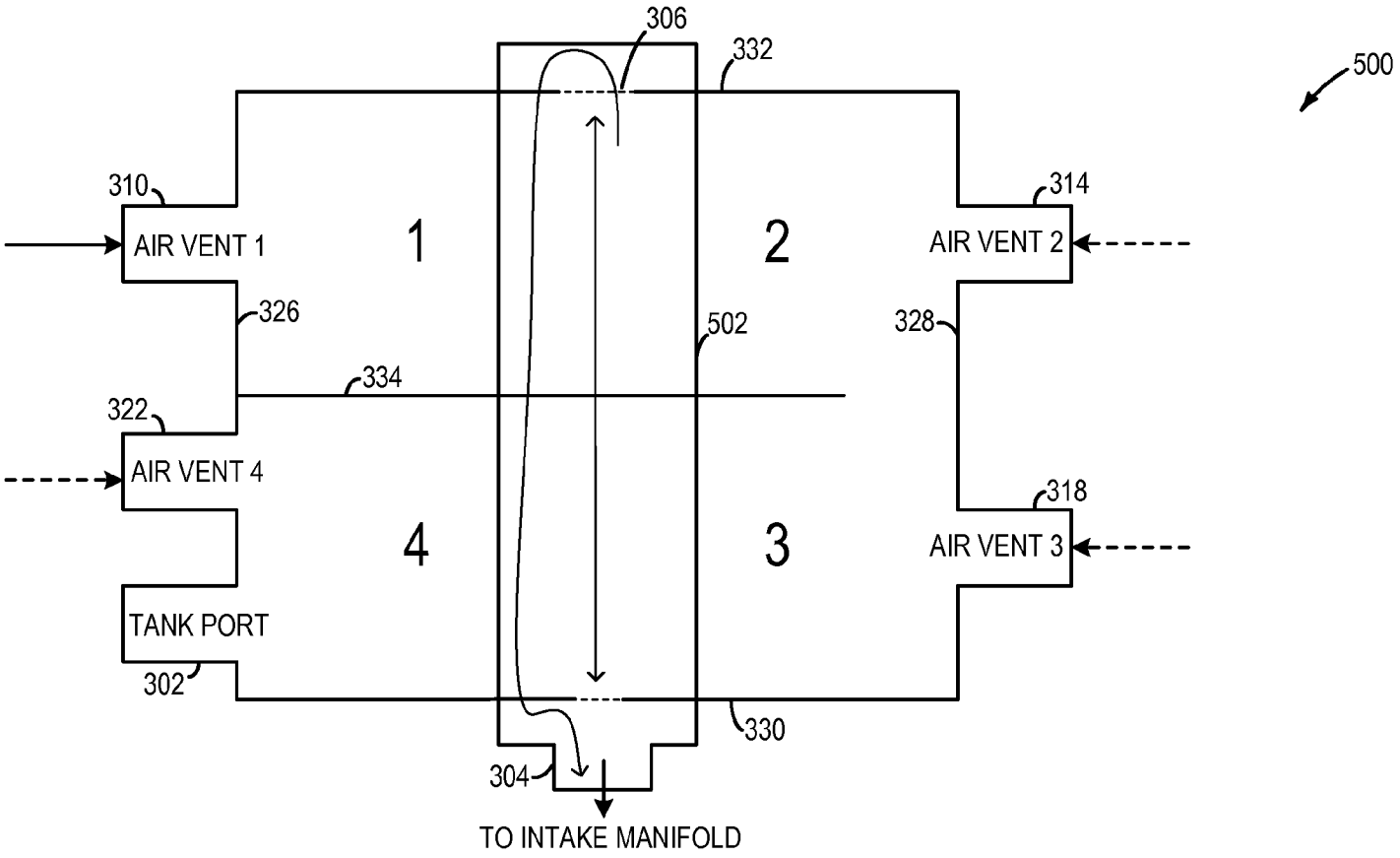

FIG. 5 shows a further embodiment 500 for the fuel vapor canister. In the depicted embodiment, the external housing of the canister on side 332 is adjusted to reduce the number of connections. In particular, a purge tube 502 having an external passageway (or external routing) is coupled between the purge ports to reduce the number of connections for purging by one. As such, this eliminates the direct connection between first purge port 306 and purge line 142 via first purge branch 342 (See FIG. 3). Instead, fuel vapors released along first purge port 306 may be directed along purge tube 502 towards second purge port 304, from where there may be directed to purge line 142 together. In this way, by using an external passageway, the number of connections coupling the canister to the purge line are reduced, making purge control easier while also reducing losses incurred due to leakage. By using a purge port that runs perpendicular to the air vents, canister restriction during purging is lowered, allowing engine air induction to be mimicked, and improving canister purging efficiency during low vacuum availability.

The fuel vapor canister of FIGS. 3-5 may be operated by controller 120 in a plurality of modes by selective adjustment of the various valves. For example, the fuel system may be operated in a fuel vapor storage mode to direct refueling vapors or diurnal vapors into the canister while preventing fuel vapors from being directed into the intake manifold. An example embodiment 600 of the canister of FIG. 3 being operated in the fuel vapor storage mode is now shown and described with reference to FIG. 6.

During a fuel tank refueling operation and with the engine not running (e.g., an engine off and/or vehicle key-off condition), canister 300 may be operated in the fuel vapor storage mode. During this mode, fuel tank isolation valve may be opened by controller 120 while vent control valve 146 and purge control valve 144 are maintained closed. By opening fuel tank isolation valve 210, refueling vapors generated in fuel tank 128 during the refueling operation can be received in canister 300 via tank port 302. By closing vent control valve 146, second, third, and fourth air vents 314, 318, and 322 are maintained closed and cannot receive atmospheric air from vent line 138 (the lack of air flow to the vents is indicated by the dashed lines). When vent control valve 146 is closed, only first air vent 310 (which is not controlled by vent control valve 146) remains open. Consequently, refueling fuel tank vapors entering tank port 302 can be vented to the atmosphere only after flowing through the greatest length of canister adsorbent (e.g., carbon) and exiting via first air vent 310 (as shown by arrow 602). This increases the residence time of the fuel vapors in the canister and improves adsorption efficiency. At the same time, by closing the purge control valve, fuel tank vapors are not leaked from the canister to the engine intake manifold 106. After a refueling operation is completed, isolation valve 210 may be closed.

During engine running, when purging conditions are not met, isolation valve 210 may remain closed while vent control valve 146 and purge control valve 144 are also maintained closed. During such conditions, diurnal or "running loss" fuel vapors may be generated in fuel tank 128. These diurnal vapors may be received in canister 300 along tank port 302 for storage by intermittently opening isolation valve 210. For example, the isolation valve may be opened intermittently in response to the fuel tank pressure becoming elevated (due to the generation of diurnal fuel vapors). As with the refueling vapors, the diurnal fuel tank vapors entering tank port 302 can be vented to the atmosphere only after flowing through the greatest length of canister adsorbent (e.g., carbon) and exiting via first air vent 310 (as shown by arrow 602).

During the refueling or fuel vapor storage mode, diverter valve 160 may be adjusted to a position based on the desired airflow to the engine. For example, if no airflow is requested (such as when the engine is not running during the refueling mode), the diverter valve may be closed to reduce an amount of air received from air cleaner 109. In comparison, if airflow is requested (such as when the engine is running during the fuel vapor storage mode), the diverter valve may be opened to increase an amount of air received from air cleaner 109.

As yet another example, the fuel vapor canister may be operated in a canister purging mode. An example embodiment 700 of the canister of FIG. 3 being operated in the canister purging mode is now shown and described with reference to FIG. 7.

After an emission control device light-off temperature has been attained and with the engine running, the canister 300 may be operated in the purging mode when a canister load is sufficiently high. During this mode, fuel tank isolation valve may be closed by controller 120 while vent control valve 146 and purge control valve 144 are opened. By closing fuel tank isolation valve 210, fuel tank vapors are not drawn into the engine intake manifold during purging (the lack of vapor flow to the tank port is indicated by the dashed line). By opening vent control valve 146, each of the second, third, and fourth air vents 314, 318, and 322 is opened, while uncontrolled first vent 210 also remains open. Thus, each of the vents is able to receive atmospheric air from vent line 138 (the presence of air flow to all the vents is indicated by the solid lines) to desorb the stored fuel vapors from the canister (as indicated by arrows 702). Herein, the air received in each of the intake air vents is substantially at or around barometric pressure conditions. Thus, air substantially at atmospheric pressure is used to desorb hydrocarbons from the canister during the purging rather than relying on an engine vacuum generated by the intake manifold (which may be limited) to draw fresh air through the vents and through fuel vapor canister 22 to purge the stored fuel vapors. In other words, fresh air enters the canister through each of the multiple vents simultaneously. The fresh air then purges fuel vapors stored in the canister, and purge air exits the canister through each of the multiple purge ports simultaneously.

The fuel vapors desorbed from canister 300 are released from first purge port 306 into first purge branch 342 and from second purge port 304 into second purge branch 343. From there, the vapors may be received in purge line 142 and delivered to the intake passage 108. During the purging, the opening of purge control valve 144 may be adjusted by controller 120 based on a desired purge flow rate. Thus, as the purge flow rate increases, the opening of purge control valve 144 may be increased.

Purge line 142 is coupled to air intake passage 108, upstream of air intake throttle 114 at diverter valve 160 (or directly into the intake manifold, 106, if the engine is configured without a throttle). Thus, during purging conditions, an opening of diverter valve 160 is coordinated with the opening of purge control valve to control an amount of fuel vapors received in the engine intake manifold 106. In particular, controller 120 adjusts an opening of diverter valve 160 so that an amount of intake air received upstream of throttle 114 is displaced with air (herein also referred to as purge air) received from the fuel system canister. Thus, as an opening of the purge control valve is opened to release more fuel vapors into purge line 142, a position of the diverter valve 160 may be adjusted so that the large amount of fuel vapors can be received in intake passage 108 by displacing a corresponding larger amount of fresh air. A remaining smaller amount of fresh air received from air cleaner 109 may be mixed with the purge air before entry into the intake manifold 106.

As shown, each of the intake air received from the air cleaner as well as purge air received from the canister are received at the diverter valve 160 coupled at the junction of the air intake passage 108 and purge line 142, upstream of the throttle 114, (or engines without throttle and only operate by controlled intake valve timing, TiVCT engines, purge air enters between diverter valve and the engine intake valves). In some embodiments, diverter valve 160 may include a chamber wherein the intake air is mixed with the air received from the canister to generate a homogenous purge air mixture before entering the engine intake manifold. Thus, by adjusting a position of the diverter valve 160, controller 120 may vary the amount of intake air that is displaced. As such, the controller may determine the amount of intake air to be displaced based on one or more of a temperature of the canister, a hydrocarbon load of the canister, controller inference tables and or Mass air sensor. As an example, the amount of intake air to be displaced may be increased or decreased, depending on engine air mass demands (e.g., based on whether engine is at idle or wide open throttle (WOT)), as the canister load increases (in anticipation of a larger amount of fuel vapors to be purged). In another example, the amount of intake air displaced by the purged fuel vapors at the diverter valve may be increased or decreased based on engine operating conditions (e.g., as the temperature of the canister increases).

During the purging mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. For example, one or more oxygen sensors (not shown) may be coupled to the canister 300 (e.g., downstream of the canister), or positioned in the engine intake and/or engine exhaust, to provide an estimate of a canister load (that is, an amount of fuel vapors stored in the canister). Based on the canister load, and further based on engine operating conditions, such as engine speed-load conditions, a purge flow rate may be determined. After a purging operation is completed, purge control valve 144 and vent control valve 146 may be closed. In addition, a position of the diverter valve 160 may be readjusted based on the requested engine air flow.

Figure 8:
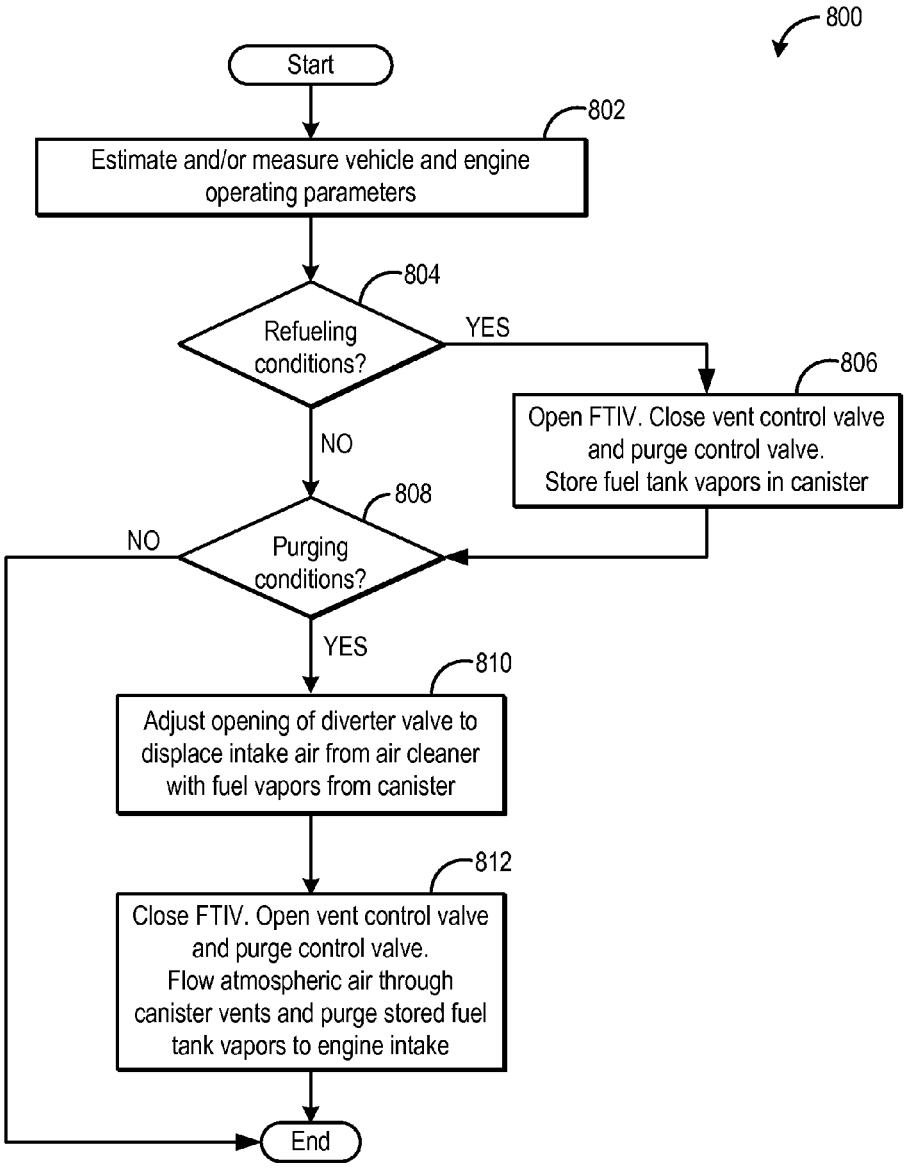
FIG. 8 shows an example of a method for controlling a fuel system canister according to an embodiment of the present disclosure.

Now turning to FIG. 8, an example method 800 is shown for operating the fuel vapor canister of FIGS. 3-5. The method enables an amount of fresh air received at the intake, upstream of a throttle (or directly into the intake manifold, 106, if without throttle), to be diverted and displaced with air received from a canister. In this way, canister purging is enabled and a homogeneous purge mixture is provided even when engine vacuum availability is limited.

At 802, the method includes estimating and/or measuring vehicle and engine operating parameters. These may include, for example, engine speed, vehicle speed, driver torque demand, barometric pressure (BP), MAP, MAF, engine temperature, catalyst temperature, battery state of charge, ambient conditions (temperature, humidity), etc.

At 804, it may be determined if refueling conditions have been met. In one example, refueling conditions may be considered met if a fuel tank fuel level is less than a threshold, a canister hydrocarbon load is less than a threshold, and a fuel tank is being refilled with the engine not running. If refueling conditions are met, then at 806, the routine includes opening a fuel tank isolation valve (FTIV) to allow fuel tank refueling vapors to be directed into a fuel vapor canister, along a tank port of the canister, for storage in the canister. In addition, a vent control valve and a purge control valve coupled to the canister may be closed. In doing so, three of the four vents of the multi-port canister may be closed, forcing refueling vapors to traverse the entire length of the canister before being vented to the atmosphere through the remaining one uncontrolled vent. In addition, the intake manifold may be isolated from the refueling vapors. The valves may be maintained in their position until the refueling is completed at which time the FTIV may also be closed.

At 808, after refueling is completed, or if refueling conditions are not met (at 804), it may be determined if purging conditions have been met. In one example, purging conditions may be considered met in response to a canister hydrocarbon load being higher than a threshold load. In another example, purging conditions may be considered met if a threshold duration of vehicle (or engine) operation has elapsed since a last purging operation. Further still, purging conditions may be considered met if a threshold distance of vehicle (or engine) operation has elapsed since a last purging operation. If purging conditions are not met, the routine may end.

If purging conditions are met, then at 810, the routine includes adjusting a position of a diverter valve coupled at a junction between the purge line (for delivering purged fuel vapors from the canister to the engine intake manifold) and the air intake passage (for delivering fresh intake air from the air cleaner to the engine intake manifold). By adjusting the position of the diverter valve, an amount of intake air received from the air cleaner may be displaced by a corresponding amount of purge air received from the canister. In other words, during purging conditions, the diverter valve enables an amount of intake air to be diverted and received via the fuel system canister. For example, as a canister load increases, a purge rate may be increased or decreased, and the diverter valve position may be adjusted so that a larger amount of fresh intake air is displaced with fuel vapors purged from the canister. A homogenous mixture of (a smaller amount of) fresh air from the air cleaner and (a larger amount of) purge air from the canister may be formed at the diverter valve, upstream of the throttle (or directly into the intake manifold, 106, if without throttle), and then the mixture may be delivered to intake manifold.

Next, at 812, the routine includes closing the fuel tank isolation valve (FTIV) to isolate the fuel tank from the canister. In addition, the vent control valve and the purge control valve coupled to the canister may be opened. By opening the vent control valve, atmospheric air may be received in the canister via each of the four vents of the multi-port canister, and the air may be used to desorb and purge the stored fuel vapors. By opening the purge control valve in a controlled manner, fuel vapors stored along the entire length of the canister can be purged to the engine intake at a desired purge rate.

The various fuel system valves may then be maintained in their position until the purging is completed at which time the vent control valve and the purge control valve may be closed. In addition, the diverter valve may be adjusted to a position that allows more airflow to be received from the air cleaner. In one example, during purging conditions, a controller may mix a first amount of intake air with a second, different amount of air received from the canister at a first (diverter) valve upstream of an intake throttle (or directly into the intake manifold, 106, if without throttle), and then deliver the mixed air to an engine intake manifold. Herein, the controller may vary a ratio of the first amount of intake air to the second amount of canister (purge) air based on one or more of a temperature of the canister and a hydrocarbon load of the canister. For example, the ratio of the first amount of intake air to the second amount of canister air may be decreased as the hydrocarbon load of the canister increases. The controller may vary the ratio by adjusting a position of the first (diverter) valve. Then, after purging the canister, the controller may increase the ratio of the first amount of intake air to the second amount of canister air. In the present example, receiving the second amount of air from the fuel system canister may include opening a second (vent control) valve coupled to a vent of the canister to receive atmospheric air in the canister through each of multiple canister vent ports simultaneously; flowing the atmospheric air through the canister to desorb stored hydrocarbons; and opening a third (purge control) valve coupled between the canister and the first (diverter) valve to direct the purged hydrocarbons simultaneously through each of multiple canister purge ports. The purged hydrocarbons may then be directed to the first (diverter) valve. As such, each of the first amount of intake air and the second amount of air received from the canister may be substantially at or around atmospheric pressure.

In another example, a hybrid vehicle system, comprises an engine including an intake manifold, and an air intake passage for delivering intake air to the intake manifold. The intake passage includes a throttle and a diverter valve positioned upstream of the throttle. The vehicle system further includes a fuel tank configured to provide fuel to an engine cylinder and a multi-port canister coupled to the fuel tank and further coupled to the air intake passage at the diverter valve. The canister is configured to store fuel vapors generated in the fuel tank. The canister includes a plurality of vent ports coupled to a vent control valve for receiving fresh air in the canister, and a plurality of purge ports coupled to a purge control valve for delivering purge air from the canister to the diverter valve. A vehicle controller may be configured with computer readable instructions for opening the purge control valve and the vent control valve in response to a canister load being higher than a threshold. In addition, the controller may adjust a position of the diverter valve to mix purge air from the canister with intake air from the intake passage, upstream of the throttle (or directly into the intake manifold, 106, if without throttle), and then deliver the air mixture to the intake manifold.

Herein, adjusting the position of the diverter valve may include adjusting the position of the diverter valve to reduce an amount of intake air in the air mixture as an amount of purge air received from the canister increases. As such, each of the intake air and the purge air received at the diverter valve may be substantially at or around atmospheric pressure. By displacing an amount of intake air directed to an engine with fuel vapors received from a canister, and by mixing intake air with the fuel vapors upstream of an intake throttle before delivering the mixture to an intake manifold, a combustion air-to-fuel ratio can be maintained. The controller may include further instructions for, after purging the canister, closing the vent control valve and the purge control valve; and adjusting the position of the diverter valve to increase the amount of intake air delivered to the intake manifold.

In this way, a fuel vapor canister may be purged using engine induction air mass flow. By reducing an amount of aircharge received upstream of an intake throttle from an intake passage when receiving purged fuel vapors upstream of the intake throttle from a fuel system canister, purge control may be coordinated with airflow control. By receiving purge vapors in the intake passage upstream of the throttle, fresh air substantially at atmospheric conditions can be used to purge the system canister. By reducing the engine intake vacuum requirement for purging, canister purging can be accomplished in low induction engine systems as well as vehicle systems with reduced engine operation times, such as HEVs. By improving the likelihood that a canister is completed purged, the likelihood of attaining zero bleed emissions from the canister is increased. Overall, vehicle emissions compliance can be improved.

Note that the example control routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Further, one or more of the various system configurations may be used in combination with one or more of the described diagnostic routines. The subject matter of the present disclosure includes all novel and non-obvious combinations and sub-combinations of the various systems and configurations, and other features, functions, and/or properties disclosed herein.

The invention claimed is:

1. A method for an engine, comprising:

displacing an amount of intake air from an intake passage upstream of a diverter valve arranged in the intake passage with air received from a fuel system canister, wherein each of the intake air and the air received from the fuel system canister are received at the diverter valve, and wherein the diverter valve is arranged upstream of an intake throttle.

2. The method of claim 1, wherein the intake air is mixed with the air received from the fuel system canister at the diverter valve before entering an engine intake manifold.

3. The method of claim 1, wherein displacing the amount of intake air includes adjusting a position of the diverter valve.

4. The method of claim 1, wherein the amount of intake air displaced is based on one or more of a temperature of the fuel system canister and a hydrocarbon load of the fuel system canister.

5. The method of claim 1, wherein the engine is boosted with a turbocharger.

6. The method of claim 1, wherein the air received from the fuel system canister includes air entering the fuel system canister through each of multiple vents simultaneously, the air purging fuel vapors stored in the fuel system canister, and the air exiting the fuel system canister through each of multiple purge ports simultaneously.

7. The method of claim 1, wherein the displacing is in response to a fuel system canister load being higher than a threshold load.

8. The method of claim 1, wherein each of the intake air and the air received from the fuel system canister are substantially at or around barometric pressure.

9. A method for an engine coupled to a fuel system canister, comprising:

during purging conditions, mixing a first amount of intake air with a second, different amount of air received from the fuel system canister at a first valve arranged in an engine intake passage upstream of an intake throttle; and delivering the mixed air to an engine intake manifold.

10. The method of claim 9, wherein a ratio of the first amount of intake air to the second amount of fuel system canister air is varied based on one or more of a temperature of the fuel system canister and a hydrocarbon load of the fuel system canister.

11. The method of claim 10, wherein the ratio of the first amount of intake air to the second amount of fuel system canister air is decreased as the hydrocarbon load of the fuel system canister increases.

12. The method of claim 10, wherein the ratio is varied by adjusting a position of the first valve.

13. The method of claim 10, further comprising, after purging the fuel system canister, increasing the ratio of the first amount of intake air to the second amount of fuel system canister air.

14. The method of claim 9, wherein the second amount of air received from the fuel system canister includes, opening a second valve coupled to a vent of the fuel system canister to receive atmospheric air in the fuel system canister through each of multiple fuel system canister vent ports simultaneously;

flowing the atmospheric air through the fuel system canister to purge stored hydrocarbons; and opening a third valve coupled between the fuel system canister and the first valve to direct the purged hydrocarbons simultaneously through each of multiple fuel system canister purge ports, the purged hydrocarbons then directed to the first valve.

15. The method of claim 9, wherein each of the first amount of intake air and the second amount of air received from the fuel system canister are substantially at or around atmospheric pressure.

16. A vehicle system, comprising:

an engine including an intake manifold;

an air intake passage for delivering intake air to the intake manifold, the intake passage including a diverter valve;

a fuel tank configured to provide fuel to an engine cylinder;

a multi-port canister coupled to the fuel tank and further coupled to the air intake passage at the diverter valve, the multi-port canister configured to store fuel vapors generated in the fuel tank, the multi-port canister including a plurality of vent ports coupled to a vent control valve for receiving fresh air in the multi-port canister, the multi-port canister further including a plurality of purge ports coupled to a purge control valve for delivering purge air from the multi-port canister to the diverter valve;

a controller with computer readable instructions for, in response to a multi-port canister load being higher than a threshold, opening the purge control valve and the vent control valve;

adjusting a position of the diverter valve to mix purge air from the multi-port canister with intake air received at the diverter valve from the intake passage upstream of the diverter valve; and delivering the air mixture to the intake manifold;

and wherein the intake passage includes an intake throttle positioned downstream of the diverter valve, and wherein adjusting the position of the diverter valve to mix purge air from the multi-port canister with the intake air received at the diverter valve from the intake passage upstream of the diverter valve includes mixing purge air from the multi-port canister with intake air at the diverter valve, upstream of the throttle.

17. The system of claim 16, wherein adjusting the position of the diverter valve includes adjusting the position of the diverter valve to reduce an amount of the intake air leaving the diverter valve from the intake passage upstream of the diverter valve in the air mixture as an amount of purge air received at the diverter valve from the multi-port canister increases.

18. The system of claim 17, wherein each of the intake air and the purge air received at the diverter valve is substantially at or around atmospheric pressure.

19. The system of claim 17, wherein the controller includes further instructions for, after purging the multi-port canister, closing the vent control valve and the purge control valve; and adjusting the position of the diverter valve to increase the amount of the intake air leaving the diverter valve from the intake passage upstream of the diverter valve that is delivered to the intake manifold.

* * * * *